US012668754B2

(12) United States Patent
Han et al.

(10) Patent No.: US 12,668,754 B2
(45) Date of Patent: Jun. 30, 2026

(54) ARYL-PAG MONOESTERS AS LUBRICATING OIL BASE STOCKS

(71) Applicant: Dow Global Technologies LLC, Midland, MI (US)

(72) Inventors: Yaokun Han, Shanghai (CN); Martin R. Greaves, Baar (CH); Cheng Shen, Shanghai (CN); Tao Wang, Shanghai (CN); Yong Zhao, Shanghai (CN); Jieying Chen, Shanghai (CN); Kang Chen, Shanghai (CN)

(73) Assignee: Dow Global Technologies LLC, Midland, MI (US)

( * ) Notice: Subject to any disclaimer, the term of this patent is extended or adjusted under 35 U.S.C. 154(b) by 42 days.

(21) Appl. No.: 18/725,972

(22) PCT Filed: Mar. 30, 2022

(86) PCT No.: PCT/CN2022/084009
§ 371 (c)(1),
(2) Date: Jul. 1, 2024

(87) PCT Pub. No.: WO2023/184219
PCT Pub. Date: Oct. 5, 2023

(65) Prior Publication Data

US 2025/0051674 A1 Feb. 13, 2025

(51) Int. Cl.

| | |
|---|---|
| ***C10M 105/34*** | (2006.01) |
| *C10N 20/02* | (2006.01) |
| *C10N 30/00* | (2006.01) |
| *C10N 30/02* | (2006.01) |

(52) U.S. Cl.
CPC .... *C10M 105/34* (2013.01); *C10M 2209/105* (2013.01); *C10M 2209/109* (2013.01); *C10N 2020/02* (2013.01); *C10N 2030/02* (2013.01); *C10N 2030/74* (2020.05)

(58) Field of Classification Search
CPC ..... C10M 105/34; C10M 2209/105; C10M 2209/109; C10M 2209/103; C10N 2020/02; C10N 2030/02; C10N 2030/74
See application file for complete search history.

(56) References Cited

U.S. PATENT DOCUMENTS

| | | | | |
|---|---|---|---|---|
| 4,606,833 | A | 8/1986 | Schuettenberg et al. | |
| 2004/0152606 | A1* | 8/2004 | Eastwood | C10M 173/02 508/505 |
| 2013/0260028 | A1* | 10/2013 | Sato | D06M 15/53 427/155 |
| 2016/0200998 | A1* | 7/2016 | Maruyama | C10M 129/70 508/501 |
| 2017/0183595 | A1* | 6/2017 | Ng | C07C 69/708 |
| 2018/0282257 | A1* | 10/2018 | Patil | C10M 169/042 |
| 2020/0318024 | A1* | 10/2020 | Han | C10M 107/34 |
| 2020/0332217 | A1* | 10/2020 | Greaves | C10M 169/041 |
| 2022/0119728 | A1* | 4/2022 | Han | C10M 145/14 |
| 2022/0127542 | A1* | 4/2022 | Han | C10M 101/00 |
| 2022/0306961 | A1* | 9/2022 | Daugs | C10M 107/34 |

FOREIGN PATENT DOCUMENTS

| | | |
|---|---|---|
| JP | 5048777 | 10/2012 |
| JP | 7305079 | 7/2023 |
| WO | 2009039018 | 3/2009 |
| WO | 2016018668 | 2/2016 |
| WO | 2016018669 | 2/2016 |
| WO | 2017116895 | 7/2017 |
| WO | 2019007636 | 1/2019 |
| WO | 2019126923 | 7/2019 |

* cited by examiner

*Primary Examiner* — Ellen M Mcavoy
(74) *Attorney, Agent, or Firm* — James T. Hoppe

(57) ABSTRACT

The present invention discloses aryl-polyalkylene glycol monoester compound compositions that are suitable for use as a base oil, particularly a base oil for use as an automotive lubricant. The compositions can generally be characterized by having low kinematic viscosity at 100° C. high viscosity index and low Noack volatility. The present invention also discloses lubricant formulations including such aryl-polyalkylene glycol monoester compounds with other materials such as an API Group I-V base oil and/or additives.

15 Claims, No Drawings

ARYL-PAG MONOESTERS AS LUBRICATING OIL BASE STOCKS

FIELD

The present disclosure is directed towards modified oil soluble polyalkylene glycols having low kinematic viscosity at 100° C. together with low volatility and high viscosity indices, and their use as a base oil.

INTRODUCTION

Most lubricants used today in equipment are manufactured using a hydrocarbon base oil. This is typically a mineral oil or a synthetic hydrocarbon oil (such as a polyalphaolefin). The American Petroleum Institute (API) has segmented hydrocarbon base oils into Group I, II, III and IV based on their viscosity indices (VI), saturate levels and sulphur levels.

Moving to lower viscosity lubricants is a macro trend in the development of modern automotive lubricants, especially for passenger car motor oils. Lower viscosity lubricants are known to offer better fuel economy, however still present some technical challenges. Lower viscosity lubricants are known to be more volatile resulting in lubricant evaporation during use. Furthermore, lower viscosity lubricants often have lower viscosity index (VI) values which is a measure of how the viscosity of the lubricant changes with temperature. Lower VI values mean a greater reduction in its viscosity at higher temperatures. Higher viscosity index values are generally preferred so that the lubricant maintains a small change in viscosity with temperature increasing from low to higher temperatures which may occur during operation of the equipment.

Base oil manufacturers are seeking to develop new ultra-low viscosity lubricant base oils which have lower Noack volatilities (as determined according to ASTM D6375) and higher viscosity index values than their predecessors. Base oils with a kinematic viscosity at 100° C. (KV100) of less than 5 mm2/sec (cSt) and preferably less than 4 cSt are desired. Base oils with a KV100 of 4 cSt or less, preferably 3.5 cSt or less, or even 3 cSt or less, together with VI greater than 130, 140 or even 150 are especially desired. Current hydrocarbon base oils in use with a KV100 of 3 cSt typically have VI values less than 120.

Recently a new range of Oil-Soluble Polyalkylene Glycols (OSP) which are named as UCON™ OSPs have been made commercially available. Unlike conventional PAGs used in lubrication which are derived from ethylene oxide (EO) and propylene oxide (PO), these OSPs are more compatible with hydrocarbon oils. OSPs are being used as co-base oils in hydrocarbon oils due to their excellent solubility and they offer excellent functionality and can improve friction control (which helps fuel economy in automotive lubricants) and deposit control (which helps fluid longevity). Unfortunately, OSPs in the low viscosity range described above typically have low VI values (that is, less than 130) and are therefore less interesting as primary base oils in lubricant formulations.

™ Trademark of The Dow Chemical Company ("Dow") or an affiliated company of Dow.

A recent publication WO2019/126923 discloses a new class of lubricants, which are OSPs which have been esterified (E-OSPs). These materials have significantly higher viscosity indices and lower volatilities than their respective parent (that is, unesterified) OSP base oils. This is especially true at the lower viscosities such those with a KV 100 of 4 and 3 cSt, but even greater improvement in terms of volatility performance is still desired.

There is need for better additive and base stock technology for lubricant compositions that will meet ever more stringent requirements of lubricant users. In particular, there is a need for advanced additive technology and synthetic base stocks with improved fuel economy, solubility and dispersibility for polar additives or sludge generated during service of lubricating oils, and oxidative stability.

SUMMARY

The present invention discloses compositions that are suitable for use as a base oil, particularly a base oil for use as an automotive lubricant. The compositions can generally be characterized by having low kinematic viscosity at 100° C., high viscosity index and low Noack volatility. The compounds comprise an aryl-polyalkylene glycol monoester compound represented by the formula:

$$R_1O\text{-}(AO)n\text{-}(C{=}O)\text{—}R_x\text{—}R_2$$

where $R_1$ is a linear or branched alkyl or aryl with 1 to 18 carbon atoms; AO refers to a 1,2-alkylene oxide or mixture thereof in a random or block feeding order; n is an integer from 1 to 10; $R_x$ is a linear or branched alkyl with 0 to 18 carbon atoms; and $R_2$ is an aryl group, heteroaryl group, or arylalkyl group with 4 to 18 carbon atoms, any of which may optionally include oxygen or nitrogen or sulfur atoms.

DETAILED DESCRIPTION

The present invention discloses compositions comprising an aryl-polyalkylene glycol ("PAG") monoester compound represented by the formula:

$$R_1O\text{-}(AO)n\text{-}(C{=}O)\text{—}R_x\text{—}R_2$$

where $R_1$ is a linear or branched alkyl or aryl with 1 to 18 carbon atoms; AO refers to a 1,2-alkylene oxide or mixture thereof in a random or block feeding order; n is an integer from 1 to 10; $R_x$ is a linear or branched alkyl with 0 to 18 carbon atoms; and $R_2$ is an aryl group, heteroaryl group, or arylalkyl group with 4 to 18 carbon atoms, any of which may optionally include oxygen or nitrogen or sulfur atoms.

While $R_1$ can be linear or branched alkyl or aryl with 1 to 18 carbon atoms, it is preferred that $R_1$ has from 1 to 12 carbon atoms. In general, it has been observed that the selection of aryl moieties tends to increase the KV100 viscosity of the molecules, and the selection of branched alkyl groups tends to decrease viscosity and improve the low temperature performance (that is, tends to decrease the pour point).

The AO group can be any 1,2, alkylene oxide, although it is preferred that it is ethylene oxide, 1,2-propylene oxide, or 1,2-butylene oxide. In general, it has been observed that the larger the alkyl group in the AO selected, the higher the molecule's miscibility will be in oil. It is also contemplated that a mixture of different AO groups may be used, and that these may be added in block or random order. Observations here show that random structure tends to lead to better oil miscibility while block structure tends to improve properties such as reduced foaming, improved demulsiblity, VI, etc.

The number of AO units, designated "n" in the formula, can be from 1 to 10, with 1 to 8 being more preferred and 2 to 6 being most preferred. In general, the number for n will be selected to provide the desired target kinematic viscosity at 100° C., with higher numbers leading to higher viscosities. As will be appreciated by those skilled in the art, the precise value for n to achieve a desired viscosity will also depend on the AO (or AOs) chosen, as well as the selections of $R_1$ $R_x$ and $R_2$.

$R_x$ is a linear or branched alkyl with 0 to 18 carbon atoms. In general, the longer the chain the greater the KV100 viscosity, the lower the Noack volatility and the higher the Viscosity Index. Branching on the $R_x$ group tends to lead to a better low temperature performance (e.g. lower pour point and low temperature viscosity).

$R_2$ is a substituted or unsubstituted aryl group, heteroaryl group, or arylalkyl group with 4 to 18 carbon atoms. If substituted, it is preferred that the substitution be oxygen or nitrogen or sulfur atoms. The presence of oxygen atoms will increase the polarity of the molecules, which tends to lead to the potential benefits of deposit control, miscibility with polarity additives, better friction profile, etc. It has been observed that the presence of nitrogen or sulfur atoms in the $R_2$ group may afford the molecule potential benefits like oxidation stability, anti-wear and extreme pressure performance, etc. It is preferred that $R_2$ contains from 1 to 3 aryl rings, more preferably 1 to 2 aryl rings.

The compositions of the present invention can be prepared by coupling a polyalkylene glycol to an aryl acidic moiety through a common esterification reaction, as known in the art. The polyalkylene glycols can be obtained from commercial sources or prepared from an alcohol having the desired configuration for $R_1$ and the desired alkylene oxide units according to methods well known in the art. The aryl acid moiety can also be obtained from commercial sources or prepared according to methods well known in the art, e.g. cyanobenzyl hydrolysis, phenylacetamide hydrolysis, etc.

It is preferred that the compounds of the present invention have a kinematic viscosity at 100° C. (KV100) as determined according to ASTM D445 of from 2 cSt, 2.5 cSt, or 3 cSt up to 6 cSt. 5 cSt, 4 cSt or 3 cSt.

It is preferred that the compounds of the present invention have a Noack volatility as determined according to ASTM D6375 of less than 45%, preferably less than 40%, 30%, 20% or even 15%.

It is preferred that the compounds of the present invention have a pour point as determined by ASTM D97 of lower than-30° C., preferably lower than-40° C.

The aryl-PAG ester compounds of the present invention can be used as the sole base oil or be used in a formulation with other base oils. If an additional base oil is used, it can advantageously be selected from an API Group 1-V base oil, with Groups III and IV being generally preferred. It is preferred that if such second base oil is present, it has a kinematic viscosity at 100° C. in the range of from 2 to 8 cSt, more preferably from 2 to 6.

Whether used as the only base oil or in a formulation with one or more other base oils, formulations including the aryl-PAG ester compounds of the present invention may also contain one or more additives, as generally known in the art. These include anti-wear agents, rust preventatives, metal deactivators, anti-hydrolysis agents, anti-static agents, defoamers, antioxidants, dispersants, detergents, extreme pressure additives, friction modifiers, viscosity index improvers, pour point depressants, tackifiers, metallic detergents, ashless dispersants and corrosion inhibitors.

If used in a formulation with other materials such as other base oils or additives, the aryl-PAG ester compounds of the present invention should preferably make up from about 5 to 99.5 percent by weight of the formulation.

The aryl-PAG ester compounds of the present invention are suitable for use as a base oil, particularly a base oil for use as an automotive lubricant.

EXAMPLES

The following examples can be used to demonstrate the efficacy of the present invention. The following test methods can be used to characterize the invention:

Kinematic viscosity is measured according to ASTM D7042 and D445.

Viscosity index is measured according to ASTM D2270.

Pour point is measured according to ASTM D97.

NOACK volatility is measured according to ASTM D6375

Table I contains a description of the materials which are used in these Examples.

TABLE 1

Raw Materials Used to Describe the Invention

| Ingredient | Acronym | Description |
|---|---|---|
| Comp Ex E | OSP-12 | Dodecanol initiated PO/BO (50/50 w/w) random copolymer with a typical kinematic viscosity at 40° C. (ASTM D7042) of 12 cSt, kinematic viscosity at 100° C. of 3 cSt, VI 88 and pour point −29° C. |
| Comp Ex B | OSP-18 | Dodecanol initiated PO/BO (50/50 w/w) random copolymer with a typical kinematic viscosity at 40° C. of 18 cSt, kinematic viscosity at 100° C. of 4 cSt, VI 121 and pour point −41° C. |
| Comp Ex F | OSP12-C5 | Esterified OSP12 by reaction of OSP-12 with valeric acid (C5), a typical kinematic viscosity at 40° C. (ASTM D7042) of 10.18 cSt, kinematic viscosity at 100° C. of 3.02 cSt, VI 167 and pour point −50° C. |
| Comp Ex C | OSP18-C5 | Esterified OSP18 by reaction of OSP-18 with valeric acid (C5), a typical kinematic viscosity at 40° C. (ASTM D7042) of 14.31 cSt, kinematic viscosity at 100° C. of 3.83 cSt, VI 171 and pour point −52° C. |
| UCON LB-65 | LB-65 | Butanol initiated PO homopolymer with a typical kinematic viscosity at 40° C. of 11 cSt, kinematic viscosity at 100° C. of 2.73 cSt, VI 83 and pour point −57° C. |
| DOWANOL TPnB | TPnB | Butanol initiated PO oligomer with typically 3 repeat units and dynamic viscosity at 25° C. of 7 cP. |
| UCON 50-HB-55IN | 50-HB-55 | Butanol initiated EO/PO (50/50 w/w) random copolymer with a typical kinematic viscosity at 40° C. of 8.3 cSt, kinematic viscosity at 100° C. of 2.36 cSt, VI 97 and pour point −62° C. |

TABLE 1-continued

Raw Materials Used to Describe the Invention

| Ingredient | Acronym | Description |
|---|---|---|
| YUBASE 3 Comp Ex D | YUBASE 3 | An API Group III base oil with a typical kinematic viscosity at 100° C. ($KV_{100}$) of 3 cSt and kinematic viscosity at 40° C. ($KV_{40}$) of 12 cSt, VI of 122 and Noack volatility of 39% (ASTM D6375). |
| YUBASE 4 Comp Ex A | YUBASE 4 | An API Group III base oil with a typical kinematic viscosity at 100° C. ($KV_{100}$) of 4 cSt, kinematic viscosity at 40° C. ($KV_{40}$) of 20 cSt, VI of 122 and Noack volatility of 15%. |
| Phenyl acetic acid | PAA | Phenyl acetic acid |
| Benzoic acid | BA | Benzoic acid |
| p-Toluenesulfonic acid | PTSA | p-Toluenesulfonic acid |
| Toluene | Toluene | Toluene |

A set of Synthesis of aryl-PAG monoesters are made as follows:

Example 1: PAA-TPnB

TPnB (181.7 g, 0.732 mol) and Phenylacetic acid (150 g, 1.1 mol) in toluene (300 mL) are stirred at room temperature. PTSA (5.6 g, 0.03 mol) are added with stirring and the mixture is refluxed with a Dean-Stark distilling trap to remove water from the system at 165° C. for 21 hours. Most of the toluene is removed by evaporation using a vacuum rotary evaporator.

A solution of 437 g of 3.65% aqueous sodium hydroxide is added to the reaction solution with stirring. After stirring for one hour at 50° C., the pH of the lower aqueous phase is 6. An additional 9.7 g of 20% aqueous sodium hydroxide is added, and stirring is continued for another hour at 50° C. The pH of the lower aqueous phase is 10. The mixture is transferred to a 2-L separatory funnel, and the aqueous phase is removed. The upper organic phase is mixed with 35 g of anhydrous magnesium silicate (MagSil), and the mixture is filtered under vacuum. Toluene is removed under vacuum at 50° C. to give a clear liquid weighing 189 g.

Example 2: PAA-50HB55

Experimental:
50HB55 (174.4 g. 0.490 mol) and Phenyl acetic acid (100 g, 0.735 mol) in toluene (300 mL) is stirred at room temperature. PTSA (1.863 g. 0.0098 mol) is added with stirring and the mixture is refluxed with a Dean-Stark distilling trap to remove water from the system at 130° C. overnight.

Saturated sodium carbonate aqueous solution (400 g) is added to the reaction solution and stirred at room temperature for 2 hours. The mixture is transferred to a 1-L separating funnel, and the aqueous phase is removed. The organic layer is dried with anhydrous magnesium sulfate. After filtration, the organic solution is dried under vacuum to give the product (200 g) as a light yellow clear oil.

Example 3: PAA-LB65

Experimental:
LB65 (333 g. 0.98 mol) and Phenylacetic acid (200 g. 1.47 mol) in toluene (300 mL) is stirred at room temperature. PTSA (7.48 g, 0.04 mol) is added with stirring and the mixture is refluxed with a Dean-Stark distilling trap to remove water from the system at 165° C. for 21 hours. Most of the toluene was removed by evaporation.

A solution of 589 g of 3.65% aqueous sodium hydroxide is added with stirring. After stirring for one hour at 50° C., the pH of the lower aqueous phase is 6. An additional 15.6 g of 20% aqueous sodium hydroxide is added, and stirring continued for another hour at 50° C. The pH of the lower aqueous phase is 10. The mixture is transferred to a 2-L separatory funnel, and the aqueous phase is removed. The upper organic phase is mixed with 35 g of anhydrous magnesium silicate (MagSil), and the mixture is filtered under vacuum. Toluene is removed under vacuum at 50° C. to give a clear liquid weighing 405 g.

Example 4: PAA-OSP12

Experimental:
UCON OSP-12 (200 g. 0.535 mol) and phenylacetic acid (100 g, 0.734 mol) in toluene (300 mL) is stirred at room temperature. PTSA (2.2 g, 0.02 mol) is added with stirring and the mixture is refluxed with a Dean-Stark distillation trap to remove water from the system at 165° C. for 21 hours. Most of the toluene is removed by evaporation.

A solution of 242 g of 3.65% aqueous sodium hydroxide is added with stirring. After stirring for one hour at 50° C., the pH of the lower aqueous phase is 6. An additional 10 g of 20% aqueous sodium hydroxide is added, and stirring continued for another hour at 50° C. The pH of the lower aqueous phase is 10. The mixture is transferred to a 1-L separatory funnel, and the aqueous phase was removed. The upper organic phase is mixed with 10 g of anhydrous magnesium silicate (MagSil), and the mixture is filtered under vacuum. Toluene is removed under vacuum at 50° C. to give a liquid weighing 190 g.

Example 5: BA-OSP12

Experimental:
UCON OSP-12 (400 g, 1.07 mol) and benzoic acid (144 g, 1.18 mol) in toluene (300 mL) is stirred at room temperature. PTSA (2.24 g, 0.012 mol) is added with stirring and the mixture is refluxed with a Dean-Stark distillation trap to remove water from the system at 165° C. for 20 hours. Additional benzoic acid (totally 30 g, 0.24 mol) is added and stirred at 165° C. until the reaction is observed to be more than 90% of the theoretical completion rate as calculated through the OH number, therefore determined to be complete. Most of the toluene is removed by evaporation.

A solution of 403 g of 3.65% aqueous sodium hydroxide is added with stirring. After stirring for one hour at 50° C., the pH of the lower aqueous phase is 6. An additional 17 g of 20% aqueous sodium hydroxide is added, and stirring continued for another hour at 50° C. The pH of the lower aqueous phase is 10. The mixture is transferred to a 2-L separatory funnel, and the aqueous phase is removed. The upper organic phase is mixed with 20 g of anhydrous magnesium silicate (MagSil), and the mixture is filtered under vacuum. Toluene is removed under vacuum at 50° C. to give a liquid weighing 390 g.

These materials were analyzed to determine KV (at 40° C. and 100° C.), VI, Pour Point and Noack volatility, and the results are presented in Table 2 (for those materials with a relatively higher KV100) and Table 3.

Comparative examples are labelled as Comp Ex. and Examples are labelled as Ex.

TABLE 2

Performance data of Aryl-PAG esters (3.5-4 cSt of KV100)

| | Comp Ex. A | Comp Ex. B | Comp Ex. C | Ex. 5 | Ex. 4 | Ex. 3 |
|---|---|---|---|---|---|---|
| Parameters | Yubase 4 | OSP18 | OSP18-C5 | BA-OSP12 | PAA-OSP12 | PAA-LB65 |
| KV40, cSt | 19.39 | 18.65 | 14.31 | 17.73 | 14.60 | 13.76 |
| KV100 cSt | 4.22 | 4.10 | 3.83 | 4.00 | 3.75 | 3.57 |
| VI | 124 | 121 | 171.2 | 124.8 | 153.4 | 147.8 |
| Pour point, ° C. | −15 | −41 | −52 | −51 | −42 | −50 |
| Noack, wt % | 14.7 | 33.5 | 33.0 | 19.5 | 11.6 | 24.0 |

KV-40, Kinematic viscosity at 40° C.
KV-100, Kinematic viscosity at 100° C.

TABLE 3

Performance data of Aryl-PAG esters (2-3 cSt of KV100)

| | Comp Ex. D | Comp Ex. E | Comp Ex. F | Ex. 1 | Ex. 2 |
|---|---|---|---|---|---|
| Parameters | Yubase 3 | OSP12 | OSP12-C5 | PAA-TPnB | PAA-50HB55 |
| KV40, cSt | 12.43 | 21.10 | 10.18 | 7.32 | 11.09 |
| KV100 cSt | 3.12 | 2.93 | 3.02 | 2.21 | 3.16 |
| VI | 112 | 88 | 167.1 | 107.5 | 159.3 |
| Pour point, ° C. | −24 | −29 | −50 | −55 | −50 |
| Noack, wt % | 40.0 | 58.6 | 41.8 | 44.0 | 33.4 |

KV-40, Kinematic viscosity at 40° C.
KV-100, Kinematic viscosity at 100° C.

Comparative Examples A and D are YUBASE 4 and YUBASE 3. These are commercial hydrocarbon base oils which are commonly used in formulating commercial lubricants. Yubase 4 has a KV100 value of about 4.2 cSt and Yubase 3 has a KV100 value of about 3.1 cSt.

Comparative Example B and E are OSP-18 and OSP-12. OSP-18 is a dodecanol initiated PO/BO (50/50 w/w), random copolymer with a typical kinematic viscosity at 40° C. of 18 cSt. OSP-12 is a dodecanol initiated PO/BO (50/50 w/w), random copolymer with a typical kinematic viscosity at 40° C. of 12 cSt.

Comparative Example C and F are OSP18-C5 and OSP12-C5. OSP18-C5 is OSP18 esterified by valeric acid. OSP12-C5 is OSP12 esterified by valeric acid.

Comparative Example A, B and C have KV100 values of about 4.0 cSt and are the benchmark samples for Examples 3-5 (These materials have KV100 values of about 3.5-4.0 cSt) as shown in Table 2.

Compared to Comparative Example A, Examples 3, 4 and 5 show significant better low temperature performance (lower pour point); Example 4 and 3 show a significant higher VI at lower viscosity grade; Example 4 shows a significant lower Noack volatility at lower viscosity grade.

Compared to Comparative Example B, Example 4 and 3 shows significant higher VI at similar or lower viscosity grade; Example 5 and 3 show significant lower pour point; Example 5, 4 and 3 all show a significant lower Noack volatility at similar or lower viscosity grade.

Compared to Comparative Example C, Example 5, 4 and 3 all show a significant lower Noack volatility at similar or lower viscosity grade.

Comparative Example D, E and F have KV100 values of about 3.0 cSt and are the benchmark samples for Example 1-2 (These materials have KV100 values of about 2.0-3.5 cSt) as shown in Table 3.

Compared to Comparative Example D, Example 2 shows a significant higher VI, and lower pour point and Noack volatility at similar viscosity grade;

Compared to Comparative Example E, Example 1 shows a significant higher VI, and lower pour point and Noack volatility at a lower viscosity grade; Example 2 shows a significant higher VI, and lower pour point and Noack volatility at similar viscosity grade;

Compared to Comparative Example F, Example 2 shows similar VI but significant lower Noack volatility at similar viscosity grade;

The invention claimed is:

1. A composition comprising an aryl-PAG monoester compound represented by the formula:

$$R_1O\text{-}(AO)n\text{-}(C{=}O)\text{—}R_x\text{—}R_2$$

where: $R_1$ is a linear or branched alkyl or aryl with 1 to 18 carbon atoms;

AO refers to a 1,2-alkylene oxide or mixture thereof in a random or block feeding order;

n is an integer from 1 to 10;

$R_x$ is a linear or branched alkyl with 0 to 18 carbon atoms; and $R_2$ is an aryl group, heteroaryl group, or arylalkyl group with 4 to 18 carbon atoms, any of which may optionally include oxygen or nitrogen or sulfur atoms.

2. The composition of claim 1 where n is selected to provide a target kinematic viscosity at 100° C. of less than 6 cSt.

3. The composition of claim 1 wherein $R_1$ is a linear or branched alkyl with 1 to 12 carbon atoms.

4. The composition of claim 1 where the 1,2-alkylene oxide is selected from the group consisting of ethylene oxide, 1,2-propylene oxide, 1,2-butylene oxide, and mixtures thereof.

5. The composition of claim 1 wherein $R_x$ is a linear alkyl with 0 to 6 carbon atoms.

6. The composition of claim 1 wherein $R_2$ is an aryl or arylalkyl group with 6 to 12 carbon atoms.

7. The composition of claim 1 wherein $R_2$ has from 1 to 3 aryl rings.

8. The composition of claim 1 characterized in that it has a kinematic viscosity at 100° C. as determined according to ASTM D445 of from 2 cSt, up to 6 cSt.

9. The composition of claim 1 characterized in that it has a Noack volatility as determined according to ASTM D6375 of less than 45%.

10. The composition of claim 1 characterized in that it has a pour point as determined by ASTM D97 of less than −40° C.

11. The composition of claim 1 characterized in that it has a kinematic viscosity at 100° C. as determined according to ASTM D445 of from 2 cSt up to 6 cSt, a Noack volatility as determined according to ASTM D6375 of less than 45%, and a pour point as determined by ASTM D97 of less than −40° C.

12. A lubricant formulation comprising a base oil which is an aryl-PAG monoester compound represented by the formula:

$$R_1O\text{-}(AO)n\text{-}(C{=}O)\text{—}R_x\text{—}R_2$$

where: $R_1$ is a linear or branched alkyl or aryl with 1 to 18 carbon atoms;

AO refers to a 1,2-alkylene oxide or mixture thereof in a random or block feeding order;

n is an integer from 1 to 10;

$R_x$ is a linear or branched alkyl with 0 to 18 carbon atoms; and $R_2$ is an aryl group, heteroaryl group, or arylalkyl group with 4 to 18 carbon atoms, any of which may optionally include oxygen or nitrogen or sulfur atoms.

13. The lubricant formulation of claim 12 further comprising one or more additional base oils where such additional base oil is an API Group I-V base oil.

14. The lubricant formulation of claim 13, where the additional base oil has a kinematic viscosity at 100° C. as determined according to ASTM D445 of from 2 cSt, up to 6 cSt.

15. The lubricant formulation of claim 12 further comprising anti-wear agents, rust preventatives, metal deactivators, anti-hydrolysis agents, anti-static agents, defoamers, antioxidants, dispersants, detergents, extreme pressure additives, friction modifiers, viscosity index improvers, pour point depressants, tackifiers, metallic detergents, ashless dispersants and corrosion inhibitors.

* * * * *